United States Patent [19]

Coulter et al.

[11] Patent Number: 4,508,046

[45] Date of Patent: Apr. 2, 1985

[54] WIND SURFING HYDROFOIL APPARATUS

[75] Inventors: James C. Coulter, Birmingham, Mich.; Michael P. Shannon, 2609 N. Lakeshore Dr., Holland, Mich. 49423

[73] Assignee: Michael P. Shannon, Holland, Mich.

[21] Appl. No.: 578,170

[22] Filed: Feb. 8, 1984

Related U.S. Application Data

[63] Continuation of Ser. No. 895,114, Apr. 10, 1978, abandoned.

[51] Int. Cl.[3] ..... B63B 1/26

[52] U.S. Cl. ..... 114/39; 114/274; 441/74

[58] Field of Search ..... 114/39, 274–282, 114/39.2; 441/68, 72, 73, 74, 79

[56] References Cited

U.S. PATENT DOCUMENTS

| | | | |
|---|---|---|---|
| 2,751,612 | 6/1956 | Shepard | 441/68 |
| 2,767,678 | 10/1956 | Vertens | 114/274 |
| 2,917,016 | 12/1959 | Schertel | 114/274 |
| 3,121,890 | 2/1964 | Rumsey, Jr. | 114/274 X |
| 3,487,800 | 1/1970 | Schweitzer | 114/39 |
| 3,707,935 | 1/1973 | Rachle | 114/39 |

*Primary Examiner*—Sherman D. Basinger
*Attorney, Agent, or Firm*—Bruce G. Klaas

[57] ABSTRACT

Wind surfing hydrofoil apparatus for enabling hydroplaning of a wind surfing board having a mast mounted centrally thereon between a front end portion and a rear end portion of the board, and comprising a front hydrofoil mounted on the board in juxtaposition to the mast for hydroplaning support of the board; and a rear hydrofoil mounted on the board rearwardly of the mast for hydroplaning support of the board and releasable mounting apparatus for clamping engagement with the board and a dagger board attached to the board between the front hydrofoil and the rear hydrofoil and extending rearwardly within the rear hydrofoil.

77 Claims, 18 Drawing Figures

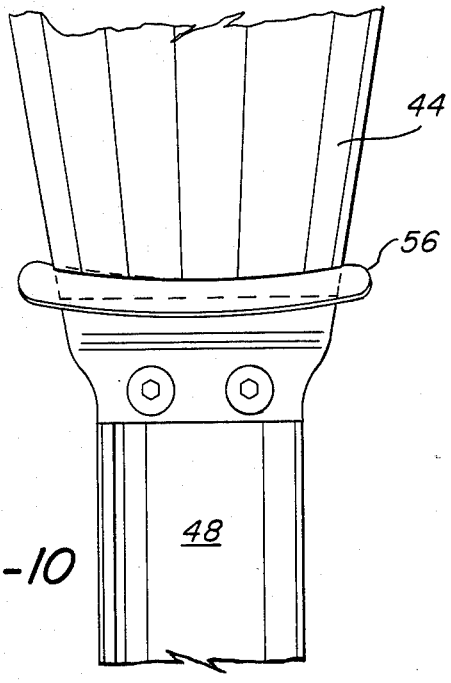
Fig-10
Fig-9
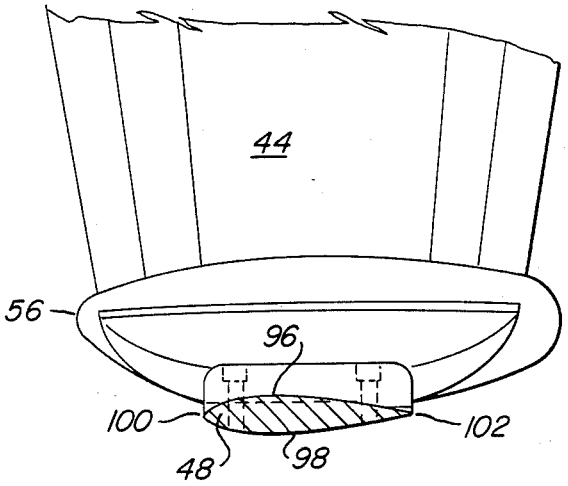
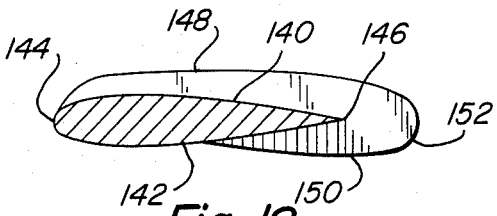
Fig-18
Fig-8
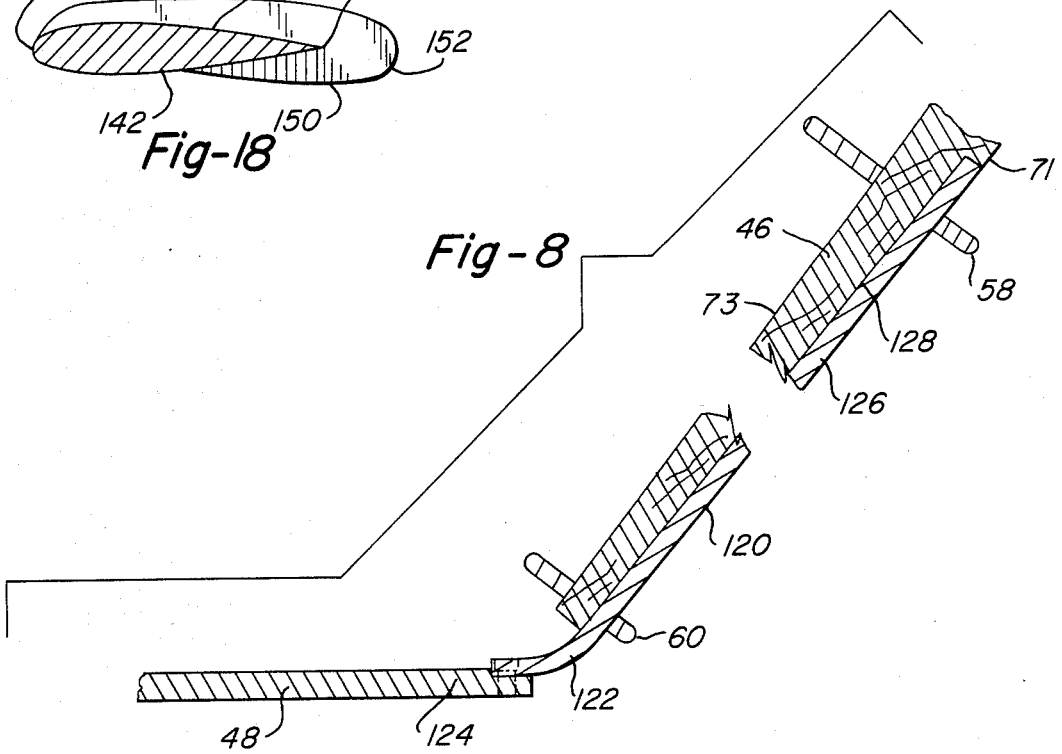

WIND SURFING HYDROFOIL APPARATUS

This is a continuation, of application Ser. No. 895,114, filed Apr. 10, 1978 and now abandoned.

BACKGROUND AND SUMMARY OF THE INVENTION

This invention relates to apparatus for wind surfing and, more particularly, to hydrofoil apparatus for use with a wind surfing board.

The sport of wind surfing has been known for many years. Conventional wind surfing apparatus is disclosed in U.S. Pat. No. 3,487,800 of Schweitzer. U.S. Pat. No. 3,996,868 is also directed to wind surfing apparatus. While there have been numerous attempts to provide hydrofoil apparatus for various aquatic sports as illustrated by U.S. Pat No. 3,121,890 for Water Ski; No. 3,164,119 for Hydrofoil Lift; No. 3,373,710 for Hydrofoil Boat; No. 3,604,031 for Hydrofoil Board; and No. 3,747,138 for Hydrofoil Surfboards; there is currently no known hydrofoil apparatus for wind surfing of which applicants are aware.

The present invention provides hydrofil apparatus for wind surfing comprising attachable and detachable hydrofoil units which enable hydroplaning of a conventional wind surfing board. The hydrofoil units are particularly adapted, constructed and designed to provide satisfactory results in use with conventional wind surfing boards which present unique hydroplaning problems because of the construction, design and manner of use thereof in the sport of wind surfing. In general, the hydrofoil units comprise a front hydrofoil means mounted on the board in juxtaposition to the mast for hydroplaning support of the board; a rear hydrofoil means mounted on the board rearwardly of the mast for hydroplaning support of the board; and releasable mounting means for clamping engagement with the board, and may also have dagger board means attached to the board between the front hydrofoil means and the rear hydrofoil means and extending rearwardly within the rear hydrofoil means. In addition, the units are constructed and arranged to be removably mounted on the wind surfing board in a manner enabling rapid mounting and demounting while also being rigidly secured in use.

DETAILED DESCRIPTION OF DRAWING

FIG. 3 is a cross-sectional view along the line 3—3 of FIG. 2;

FIG. 4 is a perspective view of one of the hydrofoil units;

FIG. 5 is a cross-sectional view of a vertical support strut member taken along line 5—5 in FIG. 3;

FIG. 8 is a cross-sectional view of through a portion of the connecting strut member and a flying wing member taken along line 8—8 in FIG. 4;

FIG. 9 is a cross-sectional view through the connecting strut member taken along line 9—9 in FIG. 4;

FIG. 10 is a partial plan view of the connecting strut member and the flying wing member of FIG. 9;

FIG. 16 is a cross-sectional view of an alternate strut member design taken along line 16—16 in FIG. 15; and FIGS. 17 & 18 are cross-sectional views showing alternative fence members.

Figure 1:
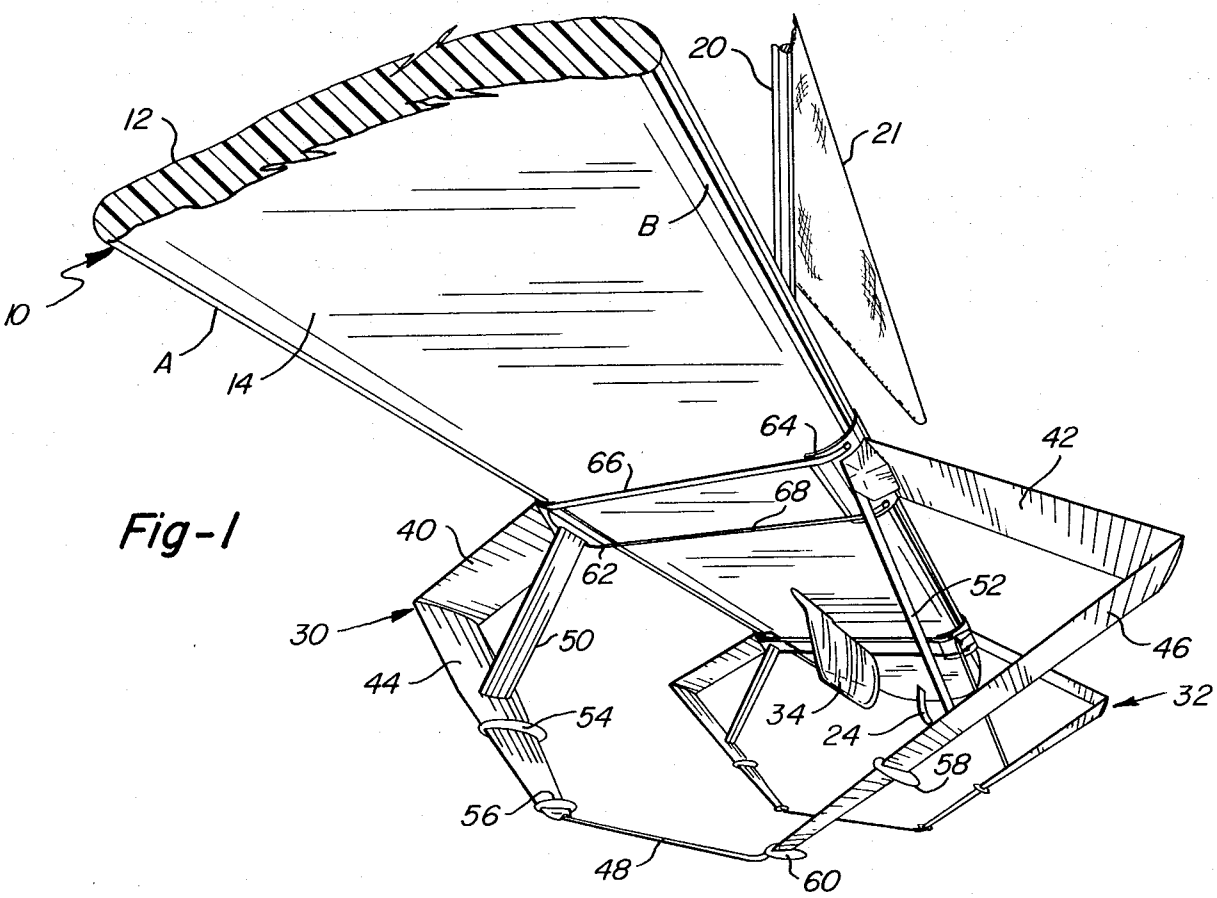
FIG. 1 is a perspective view of hydrofoil units mounted on a conventional wind surfacing board which is partially shown.
Figure 2:
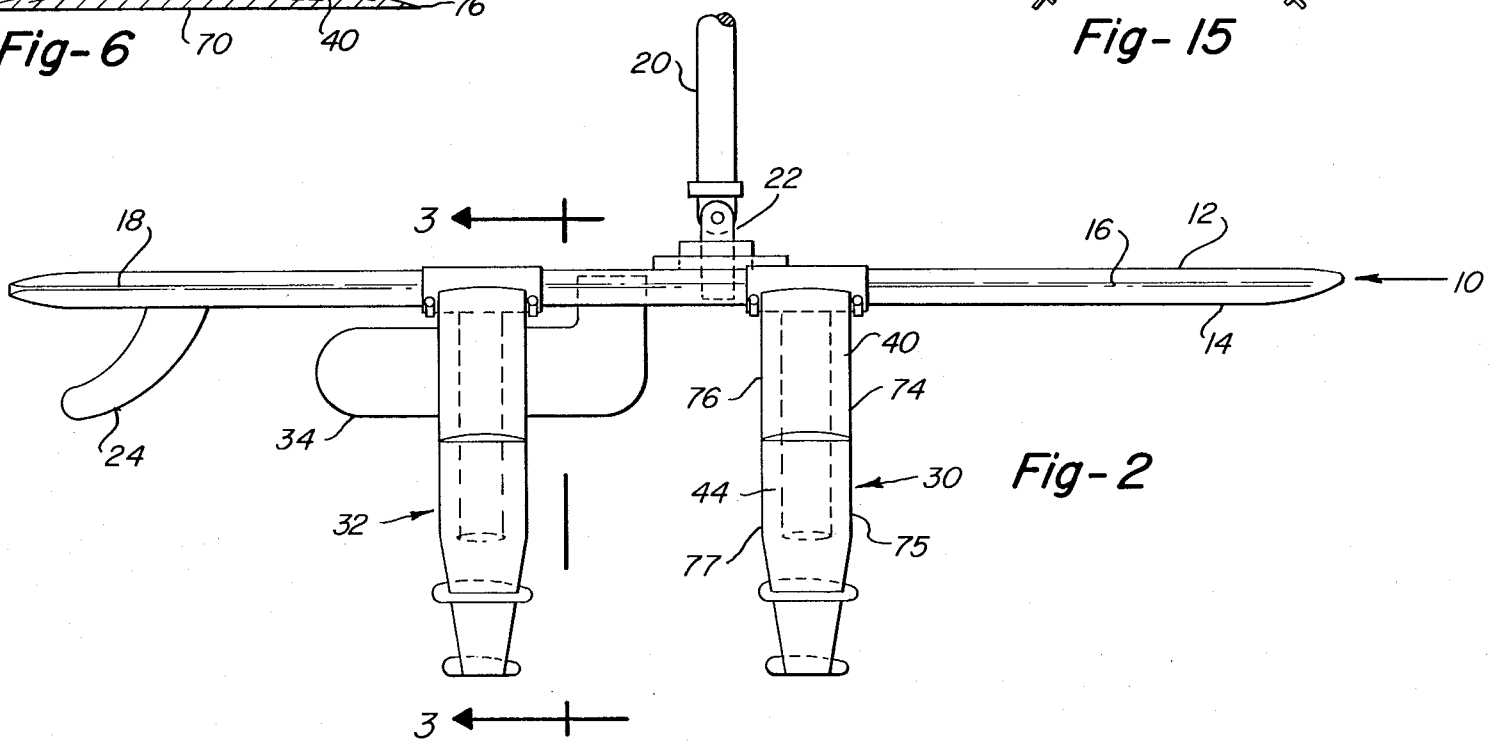
FIG. 2 is a side elevational view of hydrofoil units mounted on a conventional wind surfacing board which is schematically illustrated.

In general, as shown in FIGS. 1 & 2, the present invention is adapted for use with conventional wind surfing board apparatus comprising an elongated board member 10 having an upper surface 12, a lower surface 14 and front and rear end portions 16, 18. A conventional movable mast 20 for mounting a sail 21 is centrally universally pivotally mounted on the top of the board member by a conventional universal joint mast mounting assembly 22 as described in U.S. Pat. No. 3,487,800. A conventional skag member 24 is mounted on the rear portion of the board and extends downwardly and rearwardly from the lower surface 14.

The apparatus of the present invention comprises front and rear hydrofoil means 30, 32 fixedly mounted on the board member and extending downwardly relative to the lower surface 14. The front hydrofoil means 30 is located in juxtaposition to the mast 20 either immediately in front of the mast and mast mounting assembly 22 or therebeneath with the rear hydrofoil means 32 located intermediate the mast and mast mounting assembly and the rear portion 18 of the board. A dagger board means 34 may be centrally mounted on the board rearwardly of the mast and mast mounting assembly and extends downwardly from and rearwardly along the bottom surface 14 through the rear hydrofoil means 32.

In the presently preferred embodiment, each of the hydrofoil means 30, 32 is of the same size, shape and construction but it is contemplated that the size and shape may be varied as necessary or desirable. Each of the hydrofoil means comprises a pair of inclined outwardly downwardly extending lift-out wing means 40, 42; a pair of inclined downwardly inwardly extending flying wing means 44, 46; in one form of the invention a horizontally extending connecting strut means 48; a pair of generally vertically extending support strut means 50, 52; fence means 54, 56 and 58, 60 mounted on the flying wing means 44, 46; mounting bracket means 62, 64; and lower adjustable connecting strap means 66, 68. In an alternative form of the invention, FIG. 15, there is no connecting strut means between the flying wing means 44, 46. Each half section of each of the hydrofoil means is of the same size, shape and construction.

Figure 7:
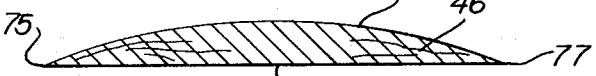
FIG. 7 is a cross-sectional view of a lifting wing member taken along line 7—7 in FIG. 3.
Figure 6:
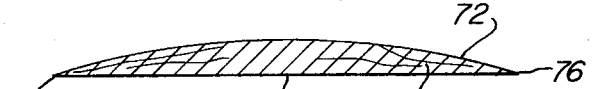
FIG. 6 is a cross-sectional view of a flying wing member taken along line 6—6 in FIG. 3.

In general, the hydrofoil wing members are of a surface piercing configuration, and of generally conventional cross-sectional configuration, such as an ogival shape, comprising a flat under surfaces 70, 71 and curved opposite upper surfaces 72, 73 intersecting the under surface to provide leading and trailing edges 74, 75 and 76, 77, FIGS. 6 & 7, being presently preferred. The lift out wing members 40, 42 and the flying wing members 44, 46 have dihedral angles (the acute angle between the wings and the water) of, respectively, approximately 30° and between approximately 35° and 50°, with 40° being presently preferred. The lift out wing members 40, 42 preferably have an angle of attack outward forward inclination relative to the direction of movement of approximately 2° to 5°, i.e., the base surfaces 72 are so inclined, and the flying wing members have a 0° angle of attack, i.e., the base surfaces 72 are parallel to the direction of movement. It is contemplated that the flying wing members of the front hydrofoil unit may be advantageously also provided with a slight angle of attack of approximately 3° to 5° for the purpose of providing additional stability.

Figures 3, 4, 5, 16, 17:
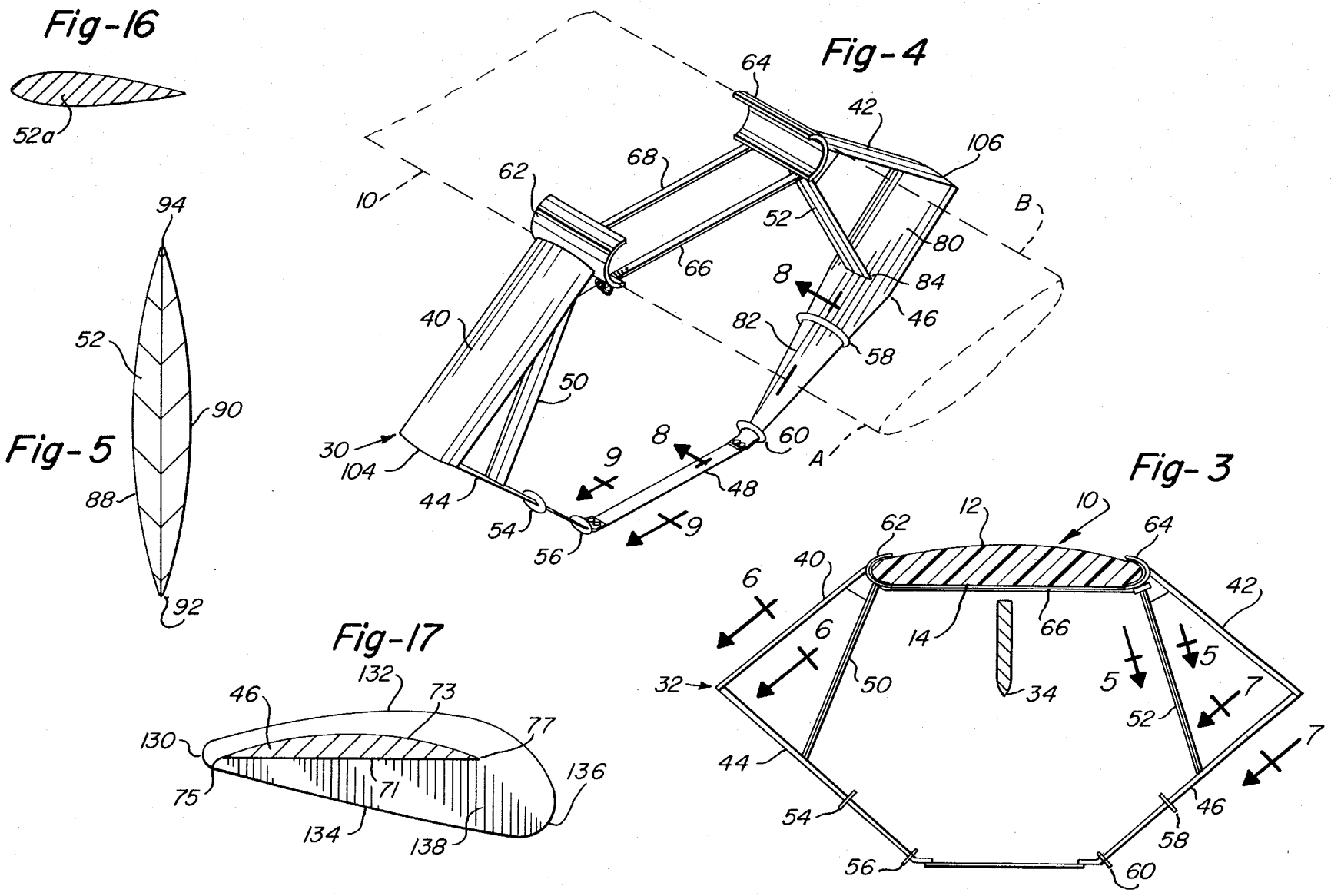
Figure 11:
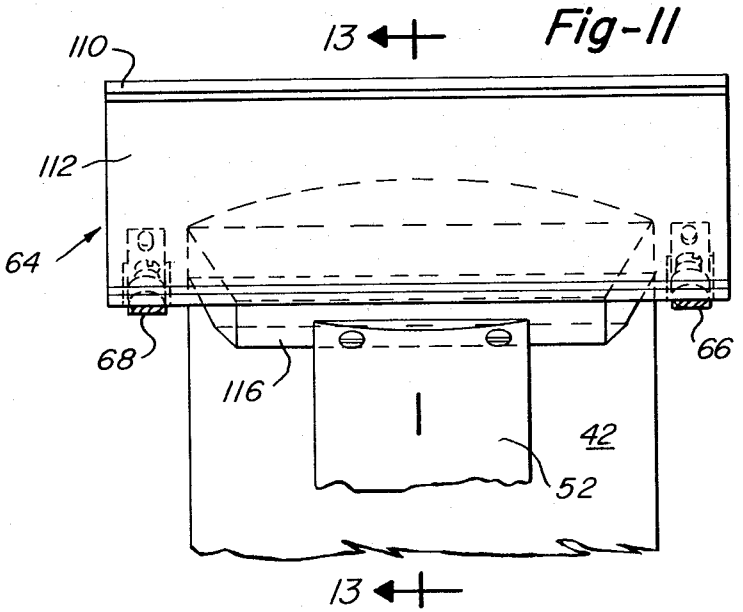
FIG. 11 is an enlarged inner side elevational view of one of the mounting clamp assemblies.
Figure 12:
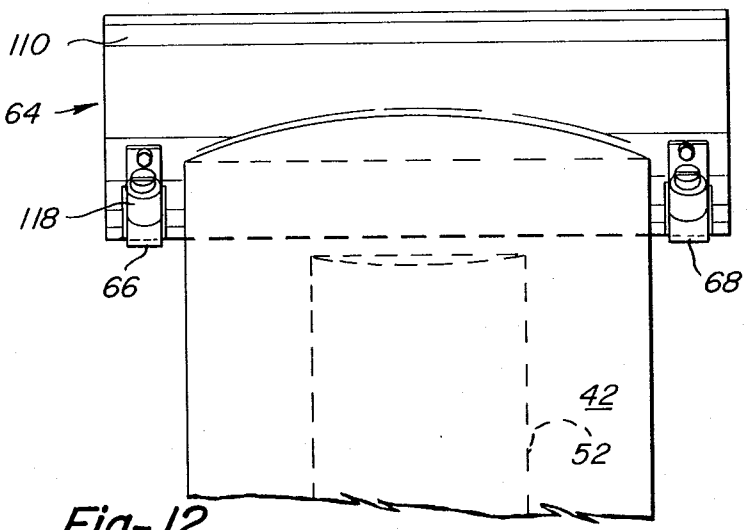
FIG. 12 is an enlarged outer side elevational view of the clamp assembly of FIG. 11.
Figure 13:
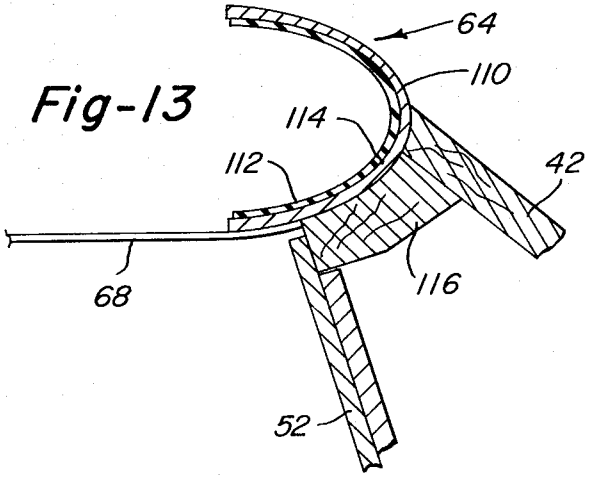
FIG. 13 is a cross-sectional view of the clamping assembly of FIG. 11.
Figure 14:
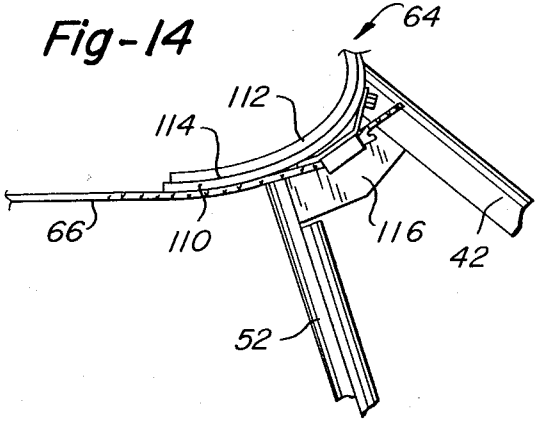
FIG. 14 is an end view of the clamping assembly of FIG. 12.

In the presently preferred embodiment, the lift out wing members 40, 42 are 6 inches wide between edges 74, 76; have a maximum thickness of ½ inch between surfaces 70, 72 to provide a thickness to chord ratio of approximately 8.3%; and a length of approximately 15 inches. The upper portions 80, FIG. 4, of the flying wing members 44, 46 are of similar size and shape as the lift out wing members; and the lower portions 82 are downwardly inwardly uniformly tapered to a minimum width of approximately 1¾ to 2¾ inches between edges 75, 77 and a minimum thickness of approximately ¼ inch between surfaces 71, 73. The flying wing members have a length of approximately 23 inches. The tapered portion 82 begins approximately at the connection area 84 of the vertical strut members 50, 52 to the flying wing members 44, 46 which is located approximately ½ of the length of the flying wing members below the connection 86 with the lift out wing members. The tapered portion may begin at any point between the vertical strut connection 84 and lift out wing connection 106 as necessary or desirable. The vertical support strut members 50, 52 may comprise a pair of sandwiched ogive cross-section members as shown in FIG. 5, having curved side surfaces 88, 90 between leading and trailing edges 92, 94, or, more preferably, a low drag N.A.C.A. Section #0012, FIG. 16. In the illustrative embodiment, strut members 50, 52 have a width of approximately 2¾ inches between edge surfaces 92, 94 a maximum thickness of approximately ½ inch between surfaces 88, 90, and a length of approximately 13½ inches. The horizontal connecting strut member 48 has a NACA #0012 low drag, cross-sectional configuration, FIG. 9, having equally curved upper and lower surfaces 96, 98 extending between leading and trailing edges 100, 102, with a width of approximately 1 9/16 inch between edge surfaces 100, 102, a maximum thickness of approximately ¼ inch between surfaces 96, 98, and a length of approximately 16 inches.

The construction and arrangement is such that each of the hydrofoil units have a draw of approximately 22 inches (measured between the bottom board surface 14 and the connecting strut member 48); an aspect ratio (length to width ratio of lifing foils) of 2.5 to 1 and 4.6 to 1, respectively, for the lift out wing members and the flying wing members; a total outboard width of approximately 54 inches measured between opposite junctions 104, 106, FIG. 4, a weight of approximately 10 pounds when made of a combination of materials including wood, aluminum alloy and steel. In the prototype design, the liftout members, the flying wing members, and the vertical strut members are made of wood with the connecting strut member being made of steel. However, it is contemplated that all members may be made out of suitable plastic materials, possibly in conjunction with metal reinforcement materials, and possibly in one integrally molded unit.

Referring to FIGS. 11–14, the clamping means assemblies 62, 64 comprise an elongated metallic plate member 110 having a generally C-shape curve cross-sectional configuration corresponding to the cross-sectional configuration of the side edge portions of the board 10. An elongated neoprene pad member 112 is mounted on the inner side surface 114 of the plate member 110. The plate member 110 is suitably fixedly rigidly connected to a mounting block member 116 to which the upper end portions of the lift wing members and vertical strut members are also suitably rigidly fixedly attached. One end of the adjustable strap members 66, 68 is fixedly secured to the plate member 110 of one clamping assembly 62 and the other end is adjutably fixedly connected to the plate member 110 of the other clamping assembly 64 by a conventional turnbuckle type adjustment means 118.

The clamping means 62, 64 and strap means 66, 68 provide a clamping system that draws the foils together, squeezing the board without causing harm or stress. This is accomplished by sliding the foils onto the board from either end (with both the board and foils in the upside down position) until each foil reaches its predesignated spot. Positioning of the foils has been determined by actual testing and is found to be just underneath the mast tee (point where the mast is connected to the board) for the front foil and 36"–44" behind it (on centers) for the rear foil. Once in position, the foils are drawn tight by an Aero-Seal Co. turnbuckle arrangement that cranks them together.

This system or any other adjustable drawing system can be used to pull from one bracket (preformed to the shape of the board) to the other. These brackets extend over the top of the board a very few inches so as to not inhibit the footing of the user. The board is protected by a thin 1/16" neoprene pad glued to each bracket. This present system of clamping is used in conjunction with a horizontal nonlifting strut that holds the foil tips together at the bottom of the configuration. When the foils are clamped to the board, the board itself is the piece that completes an enclosed unit.

Referring now to FIGS. 8–10, the connecting strut member 48 is connected to the flying wing members by a connecting metal plate member 120 having a curved inwardly tapered lower portion 122 suitably fastened to the end portion 124 of member 48 and an elongated flat portion 126 mounted in a slot 128 in the lower portion of member 46 so as to be flush with the flat lower surface 71.

Referring now to FIG. 17, the configuration of the fence members 54, 56, 58, 60 of the prototype unit completely encloses the ogive cross-sectional configuration of the lower portion 82 of member 46 with a curved leading edge surface 130, a curved upper edge surface 132, a downwardly rearwardly inclined lower edge surface 134, and a curved rear edge surface 136 providing an enlarged lower rear fin portion 138. Referring now to FIG. 18, an alternate fence design is shown with an alternate NACA high performance (i.e., NACA 4412, 66-5209) cross-section for the flying wing members having upper and lower curved surfaces and trailing edge surfaces 144, 146. In this fence design, the upper curved edge surface 148 extends from the leading edge surface 144 and a downwardly rearwardly extending lower edge surface 150 intersects an intermediate rearward portion of the lower surface 142. Upper and lower edge surfaces 148, 150 are connected by a rear curved edge surface 152. The lower fences 56 and 60 and upper fences 54, 58 are placed and positioned to prevent cavitation and ventilation respectively The lower anticavitation fence members are located closely adjacent or at the lower ends of the flying wing members and the upper antiventilation fence members are located as close as possible to the water line at hydroplaning speed. It is contemplated that the upper fence members may be adjustably fixedly mounted to enable adjustable positioning as necessary or desirable.

Figure 15:
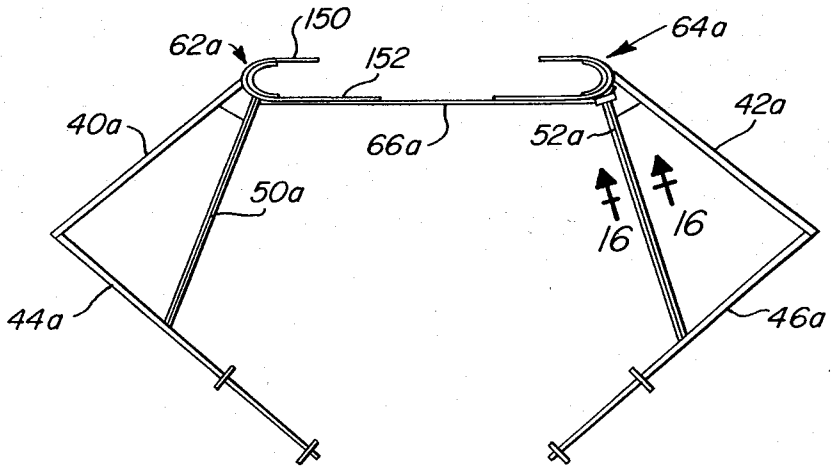
FIG. 15 is an end view of an alternative embodiment hydrofoil unit.

In the alternative embodiment of FIG. 15, the construction of wing members 40*a*, 42*a*, 44*a*, 46*a*, and strut members 50*a*, 52*a*, are as previously described. The connecting strut member 48 is removed and the clamping assemblies 62*a*, 64*a*, are modified by increasing the width of the upper and lower portions 150, 152 so as to extend inwardly from the side surfaces of the board a substantial distance sufficient to rigidify each half of the hydrofoil unit without use of the connecting strut. The construction and design of the clamping assemblies 62*a* and 64*a* is otherwise the same as previously described.

The invention claimed is:

1. Wind surfing hydrofoil apparatus for enabling hydroplaning of a wind surfing board having a mast mounted centrally thereon between a front end portion and a rear end portion of the board, and comprising:

a front hydrofoil means for being mounted below the bottom surface of the board on the side edges of the board in juxtaposition to the mast for hydroplaning support of the board;

a rear hydrofoil means for being mounted below the bottom surface of the board on the side edges of the board rearwardly of the mast for hydroplaning support of the board; and each of the front and rear hydrofoil means comprises:

a pair of inclined lift-out wing members of surface piercing and board lifting cross-sectional configuration extending outwardly and downwardly from and relative to the board beyond the side surfaces of the board;

a pair of inclined flying wing members of surface piercing and board lifting cross-sectional configuration extending downwardly and inwardly relative to and from the lift-out wing members with outermost uppermost portions located outwardly beyond the side surfaces of the board and with innermost lowermost portions located inwardly beyond the side surfaces and below the bottom surface of the board;

each flying wing member having an upper elongated portion of uniform cross-sectional size approximately equal to the cross-sectional size of said lift-out wing members and a lower elongated tapered portion of uniformly downwardly inwardly varying cross-sectional size terminating in a lower end portion of lesser cross-sectional size than said upper elongated portion;

a generally vertically extending support strut member fixedly mounted inboard of each of said pair of flying wing members and each of the associated ones of said pair of lift-out wing members and having a lower end portion thereof fixedly supportively connected to each of the associated ones of said flying wing members and having an upper end portion thereof fixedly supportively associated with the board; and mounting means for rigid attachment of the hydrofoil means to the side edge surfaces of the board.

2. The apparatus as defined in claim 1 and further comprising:

dagger board means attached to the board between the front hydrofoil means and the rear hydrofoil means and extending rearwardly within the rear hydrofoil means.

3. The invention as defined in claim 1 and wherein said lower end portion of said support strut member being fixedly connected to an intermediate portion of each of the associated ones of said flying wing members.

4. The invention as defined in claim 3 and further comprising:

a connecting strut member of non-lifting cross-sectional configuration extending between the innermost lowermost portions of the flying wing members of each of the front and rear hydrofoil means.

5. The invention as defined in claims 1 or 3 or 4 and further comprising:

a pair of spaced fence members mounted on each of said flying wing members;

one of said fence members being mounted on an upper portion of each of said flying wing members and being located at the water line during operation and having a configuration such as to prevent ventilation at hydroplaning speed; and the other of said fence members being mounted on the lower end portion of each of said flying wing members and having a configuration such as to prevent cavitation.

6. The invention as defined in claim 4 and wherein:

said connecting strut member having a low drag non-lift cross-sectional configuration defined by equally curved upper and lower surfaces which intersect to provide substantial horizontal coplanar leading and trailing edges.

7. The invention as defined in claim 1 and wherein said mounting means comprising:

a clamp member mounted on the upper portion of each of said pair of lift-out wing members and having a cross-sectional configuration corresponding to the cross-sectional configuration of the side portions of the board for clamping engagement with the upper and lower surfaces of the board member along the side portions of the board; and adjustable strap means extending across the board between opposite clamp members and being engageable with the upper or lower surface of the board for strapping the hydrofoil means to the board.

8. The invention as defined in claim 1 and wherein:

each of the upper lift-out wing members and each of the lower flying wing members having a cross-sectional configuration providing equal lifting force on opposite sides of the board during movement through water whereby the board is effectively balanced and stabilized against laterally directed forces.

9. The invention as defined in claim 8 and wherein:

there being no lifting surfaces associated with said front hydrofoil means and said rear hydrofoil means other than the lifting surfaces on said pair of upper lift-out wing members and said pair of lower flying wing members whereby the lateral balance and stabilization of the board being maintained solely by said pair of upper lift-out wing members and said pair of lower flying wing members.

10. The invention as defined in claim 9 and wherein: the effective surface area of each hydrofoil means being equal.

11. The invention as defined in claim 10 and wherein: the size and shape of each hydrofoil means being equal.

12. The invention as defined in claim 8 and wherein: the hydrofoil means being mounted in longitudinal parallel relationship with the upper lift-out wing members and the lower flying wing members of said front hydrofoil means being substantially coplanar and parallel with the corresponding upper lift-out wing members and the lower flying wing members of said rear hydrofoil means.

13. The invention as defined in claim 1 and wherein: each of the hydrofoil wing members having a surface piercing configuration comprising a flat under surface and a curved upper surface intersecting the under surface to provide a leading edge and a trailing edge.

14. The invention as defined in claim 13 and wherein: each of the hydrofoil wing members being mounted to provide dihedral angles of between approximately 30° and 50°.

15. The invention as defined in claim 14 and wherein: the lift-out wing members having a dihedral angle of approximately 30° and the flying wing members having a dihedral angle of approximately between 35° and 50°.

16. The invention as defined in claim 15 and wherein: said lift-out wing members having an angle of attack of approximately 2° to 5°.

17. The invention as defined in claim 16 and wherein: said flying wing members having an angle of attack of between approximately 0° to 5°.

18. The invention as defined in claim 17 and wherein: said lift-out wing members having a thickness to chord ratio of approximately 8.3%.

19. The invention as defined in claim 1 and wherein: each of the generally vertically extending support strut members being connected to said flying wing members adjacent the junction of said upper elongated portion and said lower elongated tapered portion.

20. The invention as defined in claim 19 and wherein: each of the vertical support strut members having a cross-sectional configuration defined by opposite curved surfaces providing leading and trailing edges facing the direction of movement to reduce drag.

21. The invention as defined in claim 1 and wherein: said lift-out wing members having an aspect ratio of approximately 2.5 to 1.

22. The invention as defined in claim 21 and wherein: said flying wing members having an aspect ratio of approximately 4.6 to 1.

23. The invention as defined in claim 1 and wherein said mounting means comprising:

releasable clamping means for mounting each of the hydrofoil means on the board.

24. The invention as defined in claim 23 and wherein: each of said vertical support strut members having an upper end portion fixedly connected to an associated one of said releasable clamping means.

25. The invention as defined in claim 24 and wherein: each of said releasable clamping means comprising an elongated metallic plate clamp member having a generally C-shape curved cross-sectional configuration corresponding to the cross-sectional configuration of the side edge portions of the board.

26. The invention as defined in claim 25 and wherein: each of said releasable clamping means further comprising:

a mounting block portion fixedly mounted on said elongated metallic plate clamp member; and the upper end portion of the associated lift-out wing member being fixedly attached to said mounting block portion.

27. The invention as defined in claim 26 and wherein: the upper end portion of the associated one of said vertical support strut members being fixedly attached to said mounting block portion inboard the associated one of said lift-out wing members.

28. The invention as defined in claim 27 and further comprising:

an adjustable strap means extending between laterally opposite ones of said releasable clamping means of each hydrofoil means for fixedly clamping the elongated metallic plate clamp members on the side edges of the board.

29. The invention as defined in claim 28 and wherein: the circumferential length of said elongated metallic plate clamp member being substantially equal to the circumferential length of the side edge surfaces of the board and having an upper end portion terminating immediately adjacent the junction of the upper surface of the board with the side edge surface of the board whereby the upper surface of the board is substantially completely unobstructed by the upper end portion of said elongated metallic plate clamp member.

30. The invention as defined in claim 23 and wherein: the upper end portion of said lift-out wing member being connected to said releasable clamping means outboard of and beneath the upper surface of the board.

31. The invention as defined in claim 1 and wherein: said mounting means being constructed and arranged to engage only the side edges of the board without obstructing any substantial portion of the upper surface of the board to enable unobstructed movement of a wind surfer rider on the upper surface of the board.

32. Wind surfing hydrofoil apparatus for enabling hydroplaning of a wind surfing board having a mast mounted centrally thereon between a front end portion and a rear end portion of the board, and comprising:

a front hydrofoil means for being mounted below the bottom surface of the board on the side edges of the board in juxtaposition to the mast for hydroplaning support of the board;

a rear hydrofoil means for being mounted below the bottom surface of the board on the side edges of the board rearwardly of the mast for hydroplaning support of the board; and each of the front and rear hydrofoil means comprises:

a pair of inclined lift-out wing members of surface piercing and board lifting cross-sectional configuration extending outwardly and downwardly from and relative to the board beyond the side surfaces of the board;

a pair of inclined flying wing members of surface piercing and board lifting cross-sectional configuration extending downwardly and inwardly relative to and from the lift-out wing members with outermost uppermost portions located outwardly beyond the side surfaces of the board and with innermost lowermost portions located inwardly beyond the side surfaces and below the bottom surface of the board;

a generally vertically extending support strut member fixedly mounted inboard of each of said pair of flying wing members and each of the associated ones of said pair of lift-out wing members and having a lower end portion thereof fixedly supportively connected to each of the associated ones of said flying wing members and having an upper end portion thereof fixedly supportively associated with the board;

mounting means for rigid attachment of the hydrofoil means to the side edge surfaces of the board;

a pair of spaced fence members mounted on each of said flying wing members;

one of said fence members being mounted on an upper portion of each of said flying wing members and being located at the water line during operation and having a configuration such as to prevent ventilation at hydroplaning speed; and the other of said fence members being mounted on the lower end portion of each of said flying wing members and having a configuration such as to prevent cavitation.

33. The apparatus as defined in claim 32 and further comprising :

dagger board means attached to the board between the front hydrofoil means and the rear hydrofoil means and extending rearwardly within the rear hydrofoil means.

34. The invention as defined in claim 32 and wherein said lower end portion of said support strut member being fixedly connected to an intermediate portion of each of the associated ones of said flying wing members.

35. The invention as defined in claim 34 and further comprising:

a connecting strut member of non-lifting cross-sectional configuration extending between the innermost lowermost portions of the flying wing members of each of the front and rear hydrofoil means.

36. The invention as defined in claim 35 and wherein:

said connecting strut member having a low drag non-lift cross-sectional configuration defined by equally curved upper and lower surfaces which intersect to provide substantial horizontal coplanar leading and trailing edges.

37. The invention as defined in claim 32 and wherein said mounting means comprising:

a clamp member mounted on the upper portion of each of said pair of lift-out wing members and having a cross-sectional configuration corresponding to the cross-sectional configuration of the side portions of the board for clamping engagement with the upper and lower surfaces of the board member along the side portions of the board; and adjustable strap means extending across the board between opposite clamp members and being engageable with the upper or lower surface of the board for strapping the hydrofoil means to the board.

38. The invention as defined in claim 32 and wherein:

each of the upper lift-out wing members and each of the lower flying wing members having a cross-sectional configuration providing equal lifting force on opposite sides of the board during movement through water whereby the board is effectively balanced and stabilized against laterally directed forces.

39. The invention as defined in claim 38 and wherein:

there being no lifting surfaces associated with said front hydrofoil means and said rear hydrofoil means other than the lifting surfaces on said pair of upper lift-out wing members and said pair of lower flying wing members whereby the lateral balance and stabilization of the board being maintained solely by said pair of upper lift-out wing members and said pair of lower flying wing members.

40. The invention as defined in claim 39 and wherein:

the effective surface area of each hydrofoil means being equal.

41. The invention as defined in claim 39 and wherein:

the size and shape of each hydrofoil means being equal.

42. The invention as defined in claim 38 and wherein:

the hydrofoil means being mounted in longitudinal parallel relationship with the upper lift-out wing members and the lower flying wing members of said front hydrofoil means being substantially coplanar and parallel with the corresponding upper lift-out wing members and the lower flying wing members of said rear hydrofoil means.

43. The invention as defined in claim 32 and wherein:

each of the hydrofoil wing members having a surface piercing configuration comprising a flat under surface and a curved upper surface intersecting the under surface to provide a leading edge and a trailing edge.

44. The invention as defined in claim 43 and wherein:

said flying wing members having an angle of attack of between approximately 0° to 5°.

45. The invention as defined in claim 44 and wherein:

said lift-out wing members having a thickness to chord ratio of approximately 8.3%.

46. The invention as defined in claim 32 and wherein:

each flying wing member having an upper elongated portion of uniform cross-sectional size approximately equal to the cross-sectional size of said lift-out wing members and a lower elongated tapered portion of uniformly downwardly inwardly varying cross-sectional size terminating in a lower end portion of lesser cross-sectional size than said upper elongated portion.

47. The invention as defined in claim 46 and wherein:

each of the generally vertically extending support strut members being connected to said flying wing members adjacent the junction of said upper elongated portion and said lower elongated tapered portion.

48. The invention as defined in claim 47 and wherein:

each of the vertical support strut members having a cross-sectional configuration defined by opposite curved surfaces providing leading and trailing edges facing the direction of movement to reduce drag.

49. The invention as defined in claim 32 and wherein:

said lift-out wing members having an aspect ratio of approximately 2.5 to 1.

50. The invention as defined in claim 49 and wherein:

said flying wing members having an aspect ratio of approximately 4.6 to 1.

51. The invention as defined in claim 32 and wherein said mounting means comprising:

releasable clamping means for mounting each of the hydrofoil means on the board.

52. The invention as defined in claim 51 and wherein:

each of said vertical support strut members having an upper end portion fixedly connected to an associated one of said releasable clamping means.

53. The invention as defined in claim 52 and wherein:

each of said releasable clamping means comprising an elongated metallic plate clamp member having a generally C-shape curved cross-sectional configuration corresponding to the cross-sectional configuration of the side edge portions of the board.

54. The invention as defined in claim 53 and wherein: each of said releasable clamping means further comprising:

a mounting block portion fixedly mounted on said elongated metallic plate clamp member; and the upper end portion of the associated lift-out wing member being fixedly attached to said mounting block portion.

55. The invention as defined in claim 54 and wherein:

the upper end portion of the associated one of said vertical support strut members being fixedly attached to said mounting block portion inboard the associated one of said lift-out wing members.

56. The invention as defined in claim 55 and further comprising:

an adjustable strap means extending between laterally opposite ones of said releasable clamping means of each hydrofoil means for fixedly clamping the elongated metallic plate clamp members on the side edges of the board.

57. The invention as defined in claim 51 and wherein:

the upper end portion of said lift-out wing member being connected to said releasable clamping means outboard of and beneath the upper surface of the board.

58. The invention as defined in claim 32 and wherein:

said mounting means being constructed and arranged to engage only the side edges of the board without obstructing any substantial portion of the upper surface of the board to enable unobstructed movement of a wind surfer rider on the upper surface of the board.

59. The invention as defined in claim 58 and wherein:

the circumferential length of said elongated metallic plate clamp member being substantially equal to the circumferential length of the side edge surfaces of the board and having an upper end portion terminating immediately adjacent the junction of the upper surface of the board with the side edge surface of the board whereby the upper surface of the board is substantially completely unobstructed by the upper end portion of said elongated metallic plate clamp member.

60. Wind surfing hydrofoil apparatus for enabling hydroplaning of a wind surfing board having a mast mounted centrally thereon between a front end portion and a rear end portion of the board, and comprising:

a front hydrofoil means for being mounted below the bottom surface of the board on the side edges of the board in juxtaposition to the mast for hydroplaning support of the board;

a rear hydrofoil means for being mounted below the bottom surface of the board on the side edges of the board rearwardly of the mast for hydroplaning support of the board; and each of the front and rear hydrofoil means comprises:

a pair of inclined lift-out wing members of surface piercing and board lifting cross-sectional configuration extending outwardly and downwardly from and relative to the board beyond the side surfaces of the board;

a pair of inclined flying wing members of surface piercing and board lifting cross-sectional configuration extending downwardly and inwardly relative to and from the lift-out wing members with outermost uppermost portions located outwardly beyond the side surfaces of the board and with innermost lowermost portions located inwardly beyond the side surfaces and below the bottom surface of the board;

a generally vertically extending support strut member fixedly mounted inboard of each of said pair of flying wing members and each of the associated ones of said pair of lift-out wing members and having a lower end portion thereof fixedly supportively connected to each of the associated ones of said flying wing members and having an upper end portion thereof fixedly supportively associated with the board; and mounting means for rigid attachment of each of said hydrofoil means to the side edge surfaces of the board comprising:

a clamp member mounted on the upper portion of each of said lift-out wing members and having a cross-sectional configuration corresponding to the cross-sectional configuration of the side portions of the board for clamping engagement with the upper and lower surfaces of the board member along the side portions of the board; and adjustable strap means extending across the board between each clamp member of each pair of lift-out wing members and being engageable with the upper or lower surface of the board for strapping the hydrofoil means to the board.

61. The apparatus as defined in claim 60 and further comprising:

dagger board means attached to the board between the front hydrofoil means and the rear hydrofoil means and extending rearwardly within the rear hydrofoil means.

62. The invention as defined in claim 60 and wherein said lower end portion of said support strut member being fixedly connected to an intermediate portion of each of the associated ones of said flying wing members.

63. The invention as defined in claim 62 and further comprising:

a connecting strut member of non-lifting cross-sectional configuration extending between the innermost lowermost portions of the flying wing members of each of the front and rear hydrofoil means.

64. The invention as defined in claims 60 or 62 or 63 and further comprising:

a pair of spaced fence members mounted on each of said flying wing members;

one of said fence members being mounted on an upper portion of each of said flying wing members and being located at the water line during operation and having a configuration such as to prevent ventilation at hydroplaning speed; and the other of said fence members being mounted on the lower end portion of each of said flying wing members and having a configuration such as to prevent cavitation.

65. Wind surfing hydrofoil apparatus for enabling hydroplaning of a wind surfing board having a mast mounted centrally thereon between a front end portion and a rear end portion of the board, and comprising:

a front hydrofoil means for being mounted below the bottom surface of the board on the side edges of the board in juxtaposition to the mast for hydroplaning support of the board;

a rear hydrofoil means for being mounted below the bottom surface of the board on the side edges of the board rearwardly of the mast for hydroplaning support of the board; and each of the front and rear hydrofoil means comprises:

a pair of inclined lift-out wing members of surface piercing and board lifting cross-sectional configuration extending outwardly and downwardly from and relative to the board beyond the side surfaces of the board;

a pair of inclined flying wing members of surface piercing and board lifting cross-sectional configuration extending downwardly and inwardly relative to and from the lift-out wing members with outermost uppermost portions located outwardly beyond the side surfaces of the board and with innermost lowermost portions located inwardly beyond the side surfaces and below the bottom surface of the board; and a generally vertically extending support strut member fixedly mounted inboard of each of said pair of flying wing members and each of the associated ones of said pair of lift-out wing members and having a lower end portion thereof fixedly supportively connected to each of the associated ones of said flying wing members and having an upper end portion thereof fixedly supportively associated with the board;

releasable clamping means for mounting each of the hydrofoil means on the board;

each of said vertical support strut members having an upper end portion fixedly connected to an associated one of said releasable clamping means;

each of said releasable clamping means comprising an elongated metallic plate clamp member having a generally C-shaped curved cross-sectional configuration corresponding to the cross-sectional configuration of the side edge portions of the board; and each of said releasable clamping means further comprising:

a mounting block portion fixedly mounted on said elongated metallic plate clamp member; and the upper end portion of the associated lift-out wing member being fixedly attached to said mounting block portion.

66. The invention as defined in claim 65 and wherein:

the upper end portion of the associated one of said vertical support strut members being fixedly attached to said mounting block portion inboard the associated one of said lift-out wing members.

67. The invention as defined in claim 66 and further comprising:

an adjustable strap means extending between laterally opposite ones of said releasable clamping means of each hydrofoil means for fixedly clamping the elongated metallic plate clamp members on the side edges of the board.

68. The invention as defined in claim 67 and wherein:

the circumferential length of said elongated metallic plate clamp member being substantially equal to the circumferential length of the side edge surfaces of the board and having an upper end portion terminating immediately adjacent the junction of the upper surface of the board with the side edge surface of the board whereby the upper surface of the board is substantially completely unobstructed by the upper end portion of said elongated metallic plate clamp member.

69. The invention as defined in claim 65 and wherein:

the upper end portion of said lift-out wing member being connected to said releasable clamping means outboard of and beneath the upper surface of the board.

70. The apparatus as defined in claim 65 and further comprising:

dagger board means attached to the board between the front hydrofoil means and the rear hydrofoil means and extending rearwardly within the rear hydrofoil means.

71. The invention as defined in claim 65 and wherein said lower end portion of said support strut member being fixedly connected to an intermediate portion of each of the associated ones of said flying wing members.

72. The invention as defined in claim 71 and further comprising:

a connecting strut member of non-lifting cross-sectional configuration extending between the innermost lowermost portions of the flying wing members of each of the front and rear hydrofoil means.

73. The invention as defined in claim 72 and wherein:

said connecting strut member having a low drag non-lift cross-sectional configuration defined by equally curved upper and lower surfaces which intersect to provide substantial horizontal coplanar leading and trailing edges.

74. The invention as defined in claims 65 or 71 or 72 and further commprising:

a pair of spaced fence members mounted on each of said flying wing members;

one of said fence members being mounted on an upper portion of each of said flying wing members and being located at the water line during operation and having a configuration such as to prevent ventilation at hydroplaning speed; and the other of said fence members being mounted on the lower end portion of each of said flying wing members and having a configuration such as to prevent cavitation.

75. The invention as defined in claim 65 and wherein:

each flying wing member having an upper elongated portion of uniform cross-sectional size approximately equal to the cross-sectional size of said lift-out wing members and a lower elongated tapered portion of uniformly downwardly inwardly varying cross-sectional size terminating in a lower end portion of lesser cross-sectional size than said upper elongated portion.

76. The invention as defined in claim 75 and wherein:

each of the generally vertically extending support strut members being connected to said flying wing members adjacent the junction of said upper elongated portion and said lower elongated tapered portion.

77. The invention as defined in claim 76 and wherein:

each of the vertical support strut members having a cross-sectional configuration defined by opposite curved surfaces providing leading and trailing edges facing the direction of movement to reduce drag.

* * * * *